US005456225A

United States Patent [19]

Oikawa et al.

[11] Patent Number: 5,456,225

[45] Date of Patent: Oct. 10, 1995

[54] VALVE OPERATING DEVICE FOR INTERNAL COMBUSTION ENGINE

[75] Inventors: Toshihiro Oikawa; Kenji Nakajima; Yoshiaki Iizuka; Tomoki Okita; Yukio Nakayama, all of Saitama, Japan

[73] Assignee: Honda Giken Kogyo Kabushiki Kaisha, Tokyo, Japan

[21] Appl. No.: 292,557

[22] Filed: Aug. 18, 1994

[30] Foreign Application Priority Data

Aug. 18, 1993 [JP] Japan ..... 5-203844

[51] Int. Cl.[6] ..... F01L 13/00

[52] U.S. Cl. ..... 123/90.16; 123/90.44

[58] Field of Search ..... 123/90.15, 90.16, 123/90.17, 90.39, 90.44, 90.6

[56] References Cited

U.S. PATENT DOCUMENTS

| | | | |
|---|---|---|---|
| 4,799,463 | 1/1989 | Konno | 123/90.16 |
| 5,085,182 | 2/1992 | Nakamura et al. | 123/90.16 |
| 5,095,859 | 3/1992 | Iwata et al. | 123/90.16 |

FOREIGN PATENT DOCUMENTS

| | | |
|---|---|---|
| 0276531 | of 1988 | European Pat. Off. . |
| 36801 | 2/1991 | Japan . |
| 2197686 | of 1988 | United Kingdom . |

*Primary Examiner*—Henry C. Yuen
*Assistant Examiner*—Weilun Lo
*Attorney, Agent, or Firm*—Lyon & Lyon

[57] ABSTRACT

A valve operating device for use in an internal combustion engine for varying operating characteristics of a pair of engine valves (20) in multi-stages depending upon operating conditions of the engine. A cam shaft (31) is provided with a high-speed cam (32), a pair of medium-speed cams disposed on opposite sides of the high-speed cam (32), and a pair of low-speed cams (34) disposed between the medium-speed cams (33) and the high-speed cam (32). A rocker shaft (35) is provided with a first free rocker arm (36) in sliding contact with the high-speed cam (32), a pair of driving rocker arms (37) operatively connected to the pair of engine valves (20), respectively, and in sliding contact with the low-speed cams (34), and a pair of second free rocker arms (38) disposed with the driving rocker arms (37) interposed between the second free rocker arms (38) and the first free rocker arm (36) to be in sliding contact with the medium-speed cams (33). First and second connection switching means (39, 40) are provided and separately switchable between states for selectively connecting the various rocker arms for operating the driving rocker arms (37) and engine valves (20) in low-speed, medium-speed and high-speed operating ranges of the engine.

6 Claims, 7 Drawing Sheets

VALVE OPERATING DEVICE FOR INTERNAL COMBUSTION ENGINE

The present invention relates to a valve operating device for use in an internal combustion engine for varying operating characteristics of a pair of engine valves in multi-stages depending upon operating conditions of the engine.

Such valve operating devices have been already known, for example, from Japanese Utility Model Publication No. 6801/91.

In the above prior art device, four cams having different profiles are provided to come into sliding contact with four rocker arms disposed adjacent one another, including two rocker arms independently operatively connected to a pair of intake valves, so that the connection and disconnection of adjacent rocker arms can be switched from each other, and the operating characteristics of the pair of intake valves can be switched through at least four or more stages. However, the rocker arm corresponding to the high-speed cam having the profile corresponding to the high-speed operating range of the engine is disposed at one end of the arrangement of adjoining rocker arms. For this reason, in opening and closing the intake valves by the high-speed cam with all the rocker arms connected to one another, the driving force from the high-speed cam is applied so that the rocker arm in sliding contact with the high-speed cam and the rocker arm adjacent such rocker arm are moved away from each other at their connected portions, resulting in a problem in the rigidity of all the rocker arms connected to one another and in a risk that the driving force from the high-speed cam is not transmitted equally to the intake valves.

The present invention has been accomplished with such circumstance in view, and it is an object of the present invention to provide a valve operating device for use in an internal combustion engine, wherein the rigidity of all the rocker arms connected to one another is insured and the driving force can be transmitted equally to the intake valves, and moreover, the operating characteristics of the engine valves can be varied depending upon low-speed, medium-speed and high-speed operating ranges of the engine.

To achieve the above object, according to the present invention, there is provided a valve operating device for use in an internal combustion engine for varying operating characteristics of a pair of engine valves at multi-stages depending upon operating conditions of the engine, the device comprising a cam shaft which is provided with a high-speed cam having a profile corresponding to a high-speed operating range of the engine, a pair of mediumspeed cams disposed on opposite sides of the high-speed cam and having profiles corresponding to a medium-speed operating range of the engine, and a pair of low-speed cams disposed between the medium-speed cams and the high-speed cam, respectively, and having a profile corresponding to a low-speed operating range of the engine; a rocker shaft which is provided with a first free rocker arm positioned in sliding contact with the high-speed cam, a pair of driving rocker arms operatively connected to the pair of engine valves, respectively and positioned in sliding contact with the low-speed cams, and a pair of second free rocker arms disposed with the driving rocker arms interposed between the second free rocker arms themselves and the first free rocker arm to be positioned in sliding contact with the medium-speed cam, the rocker arms being commonly carried on the rocker shaft for relative swinging movements; a first connection switching means which is provided in the first free rocker arm and the driving rocker arms disposed on the opposite sides of the first free rocker arm and which is switchable between a state in which it connects the first free rocker arm and the driving rocker arms in the high-speed operating range of the engine and a state in which it disconnects the first free rocker arm and the driving rocker arms in the low-speed and medium-speed operating ranges of the engine; and second connection switching means each provided in the adjacent driving rocker arms and second free rocker arms, respectively, and switchable between states in which they connect the adjacent driving rocker arms and the second free rocker arms, respectively, and apply a biasing force to the driving rocker arms in a direction toward the first free rocker arm, and states in which they disconnect the adjacent driving rocker arms and the second free rocker arms, respectively.

EMBODIMENT

The present invention will now be described by way of a preferred embodiment in connection with the accompanying drawings, wherein.

Figure 1:
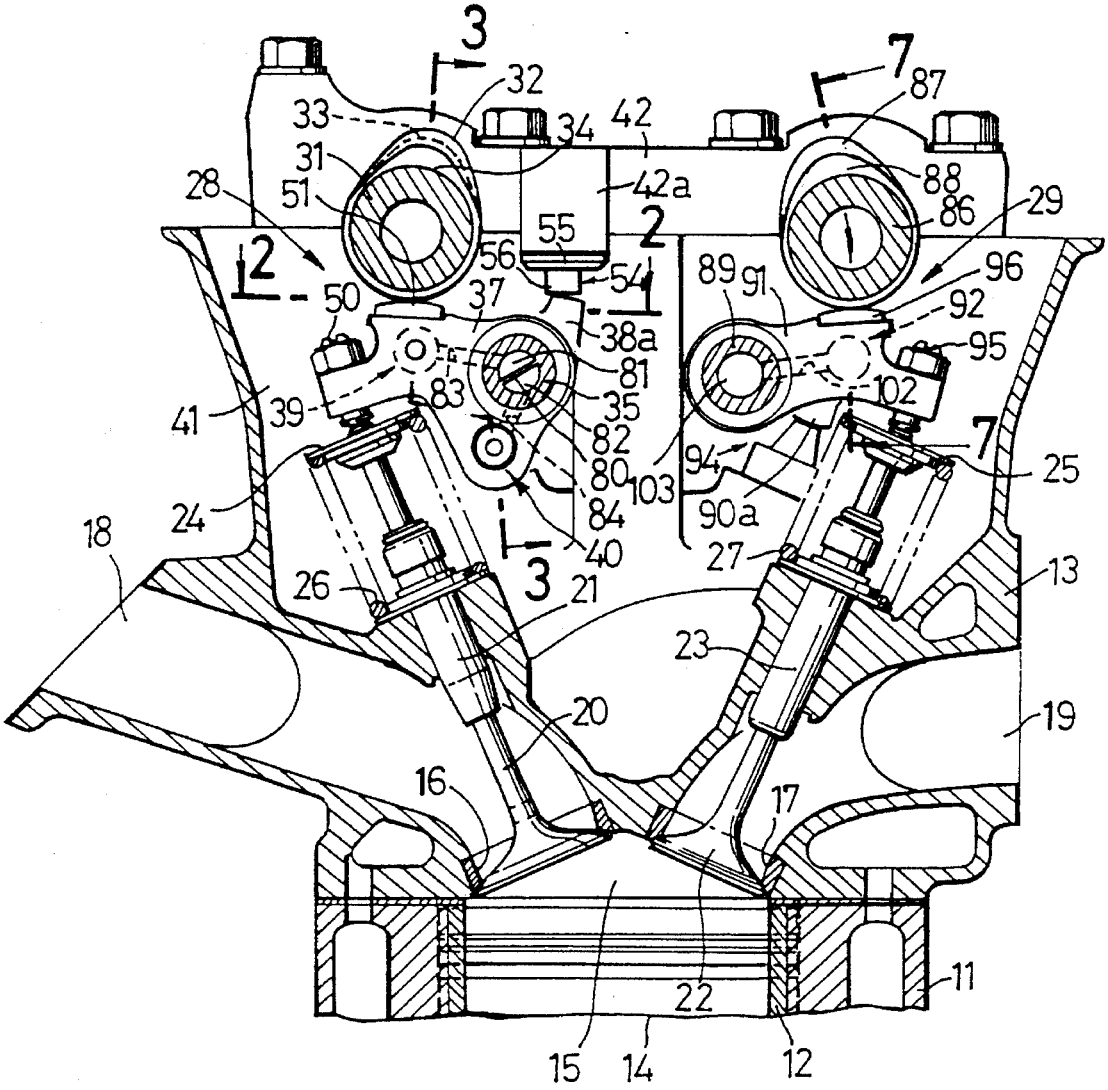
FIG. 1 is a vertical sectional view of the valve operating portion of an internal combustion engine.
Figure 6A:
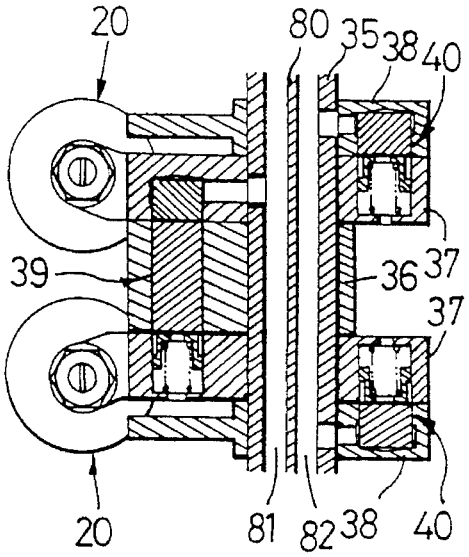
Figure 6B:
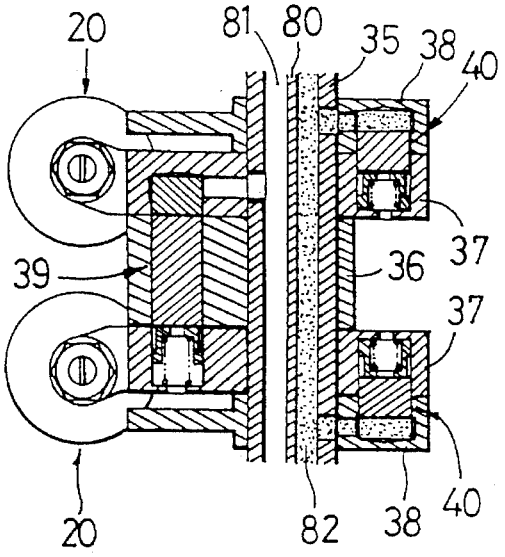
Figure 6C:
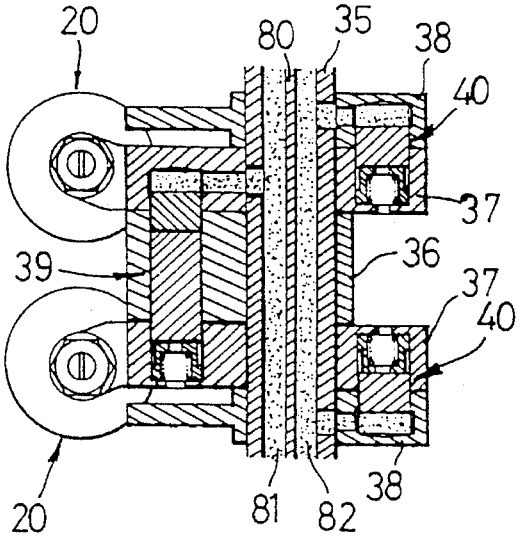
Figure 7:
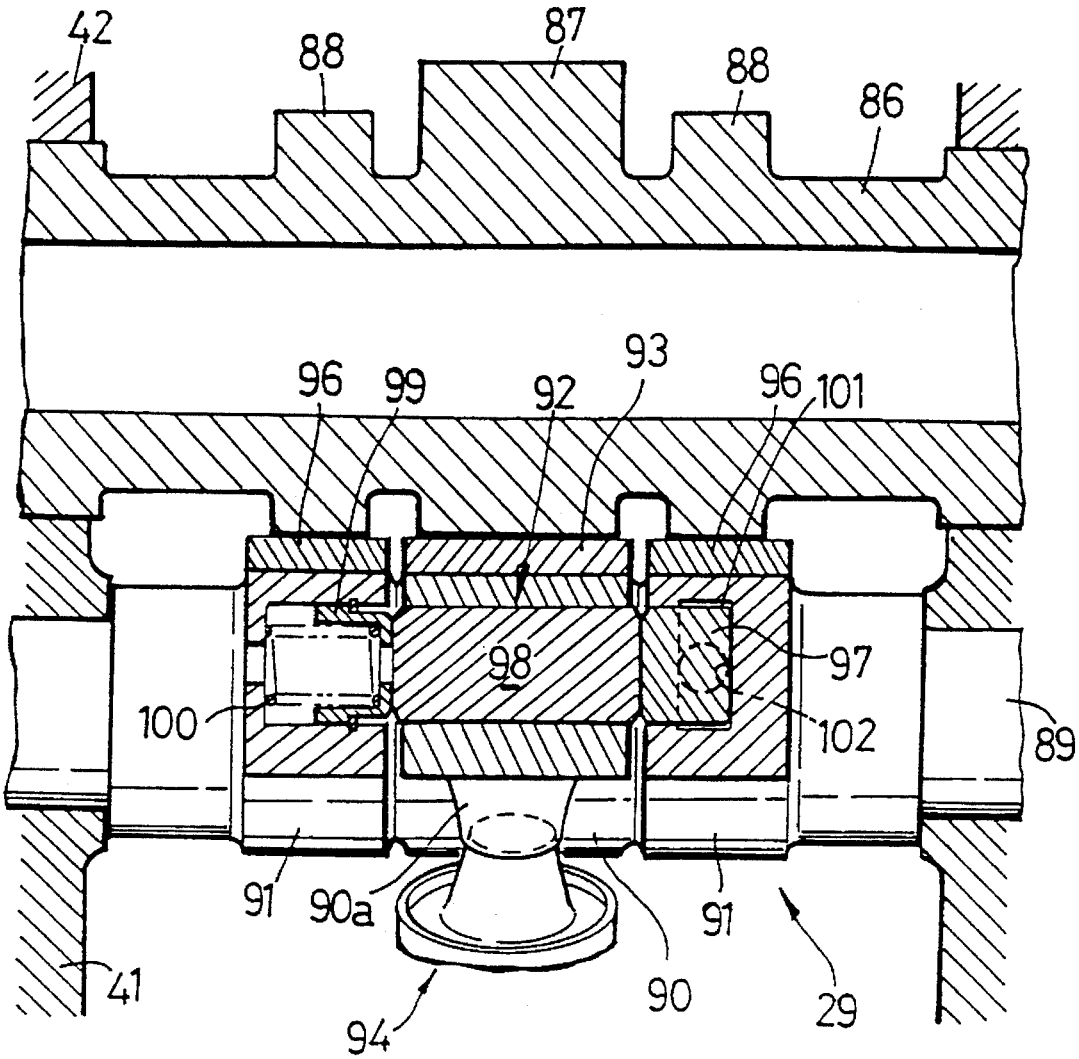

FIG. 6 comprised of FIGS. 6A, 6B and 6C, is a cross-sectional view for illustrating operational states of an intake-side valve operating device in sequence; and FIG. 7 is an enlarged sectional view taken along a line 7—7 in FIG. 1.

FIGS. 1 to 7 illustrate a preferred embodiment of the present invention. Referring first to FIG. 1, in a DOHC type multi-cylinder internal combustion engine, a plurality of cylinders 12 are provided in a series arrangement within a cylinder block 11. A combustion chamber 15 is defined between a cylinder head 13 coupled to an upper end of the cylinder block 11 and a piston 14 slidably received in each of the cylinders 12. The cylinder head 13 has a pair of intake valve bores 16 and a pair of exhaust valve bores 17 provided in an area forming a ceiling surface of each of the combustion chambers 15. The cylinder head 13 is provided with an intake port 18 which opens into one side of the cylinder head 13 to communicate with both the intake valve bores 16. The cylinder head 13 is also provided with an exhaust port 19 which opens into the other side of the cylinder head 13 to communicate with both the exhaust valve bores 17.

A pair of guide sleeves 21 are fixedly fitted into a portion of the cylinder head 13 corresponding to each of the cylinders 12 for guiding intake valves 20 as a pair of engine valves capable of opening and closing the intake valve bores 16, respectively. A pair of guide sleeves 23 are also fixedly fitted into such portion for guiding exhaust valves 22 capable of opening and closing the exhaust valve bores 17 respectively. Valve springs 26 and 27 are provided under compression between the cylinder head 13 and collars 24 and 25 provided at upper ends of the intake and exhaust valves 20 and 22 projecting upwardly from the guide sleeves 21 and 23, respectively, so that the intake and exhaust valves 20 and 22 are biased upwardly, i.e., in respective closing directions by spring forces of the valve springs 26 and 27, respectively.

An intake-side valve operating device 28 is connected to the intake valves 20 to open and close the intake valves 20 in three-stage operating characteristics corresponding to the operating conditions of the engine. An exhaust-side valve operating device 29 is connected to the exhaust valves 22 to open and close the exhaust valves 22 in two-stage operating characteristics corresponding to the operating conditions of the engine.

Figure 2:
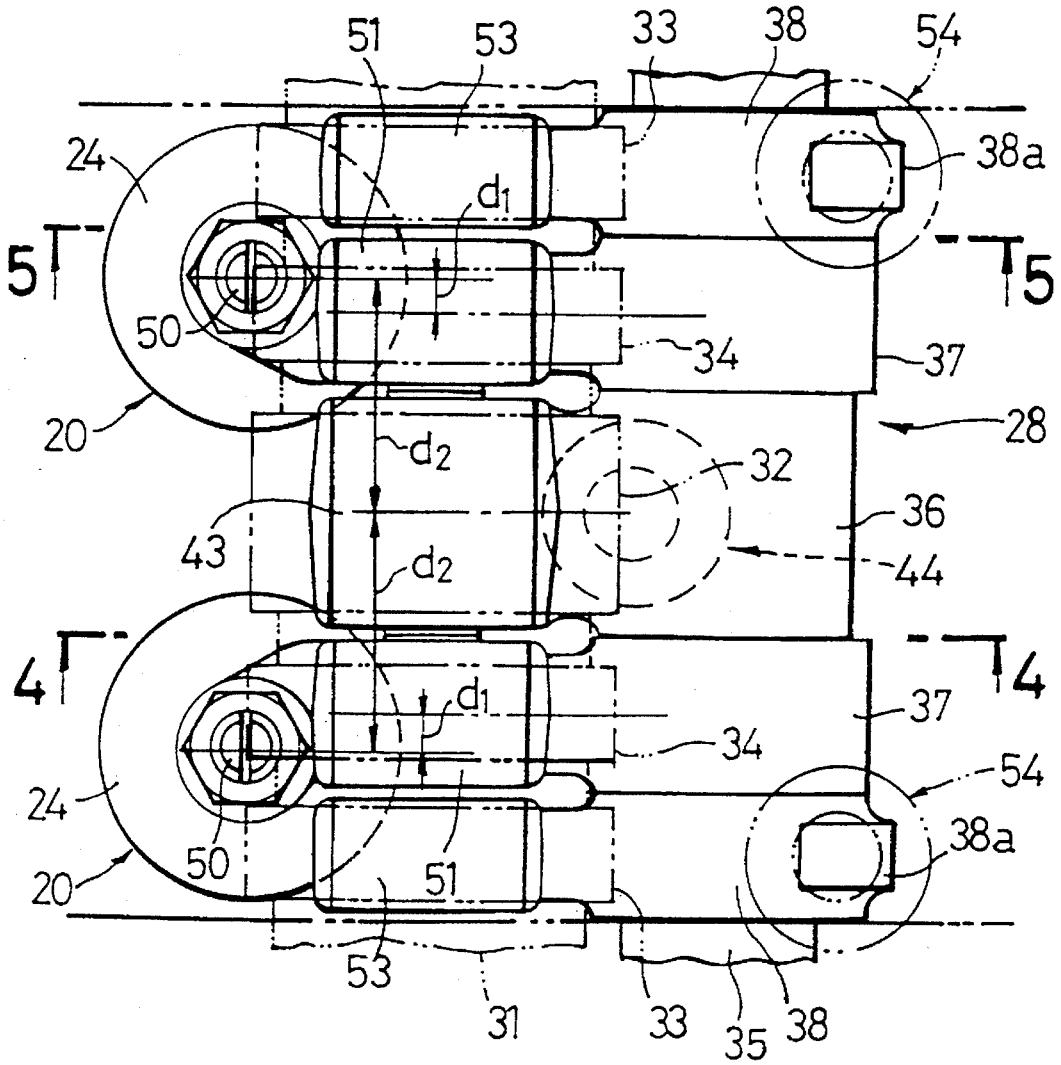
FIG. 2 is an enlarged sectional view taken along a line 2—2 in FIG. 1.
Figure 3:
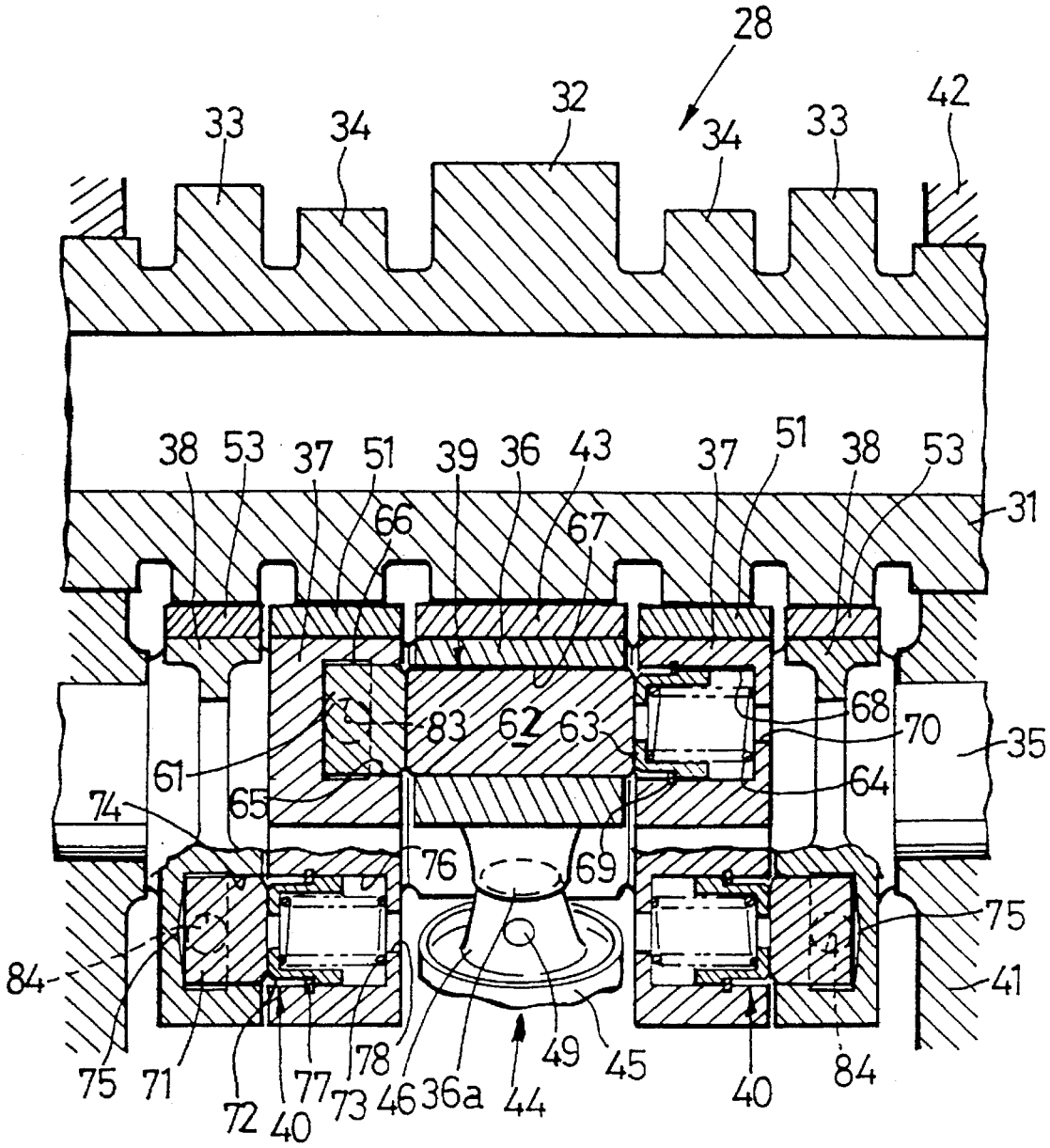
FIG. 3 is an enlarged view taken along a line 3—3 in FIG. 1.

Referring also to FIGS. 2 and 3, the intake-side valve operating device 28 includes a cam shaft 31 rotatively driven at a reduction ratio of ½ from a crank shaft (not shown) of the engine, a single high-speed cam 32, a pair of medium-speed cams 33, 33 and a pair of low-speed cams 34, 34, all of which cams are provided on the can shaft 31, a rocker shaft 35 fixedly disposed parallel to the cam shaft 31, a single first free rocker arm 36, a pair of driving rocker arms 37, 37, a pair of second free rocker arms 38, 38, all of which rocker arms are swingably carried on the rocker shaft 35, a first connection switching means 39 provided on the first free rocker arm 36 and the driving rocker arms 37, 37, and second connection switching means 40, 40 provided on the adjacent driving rocker arms 37 and second free rocker arms 38.

Figure 4:
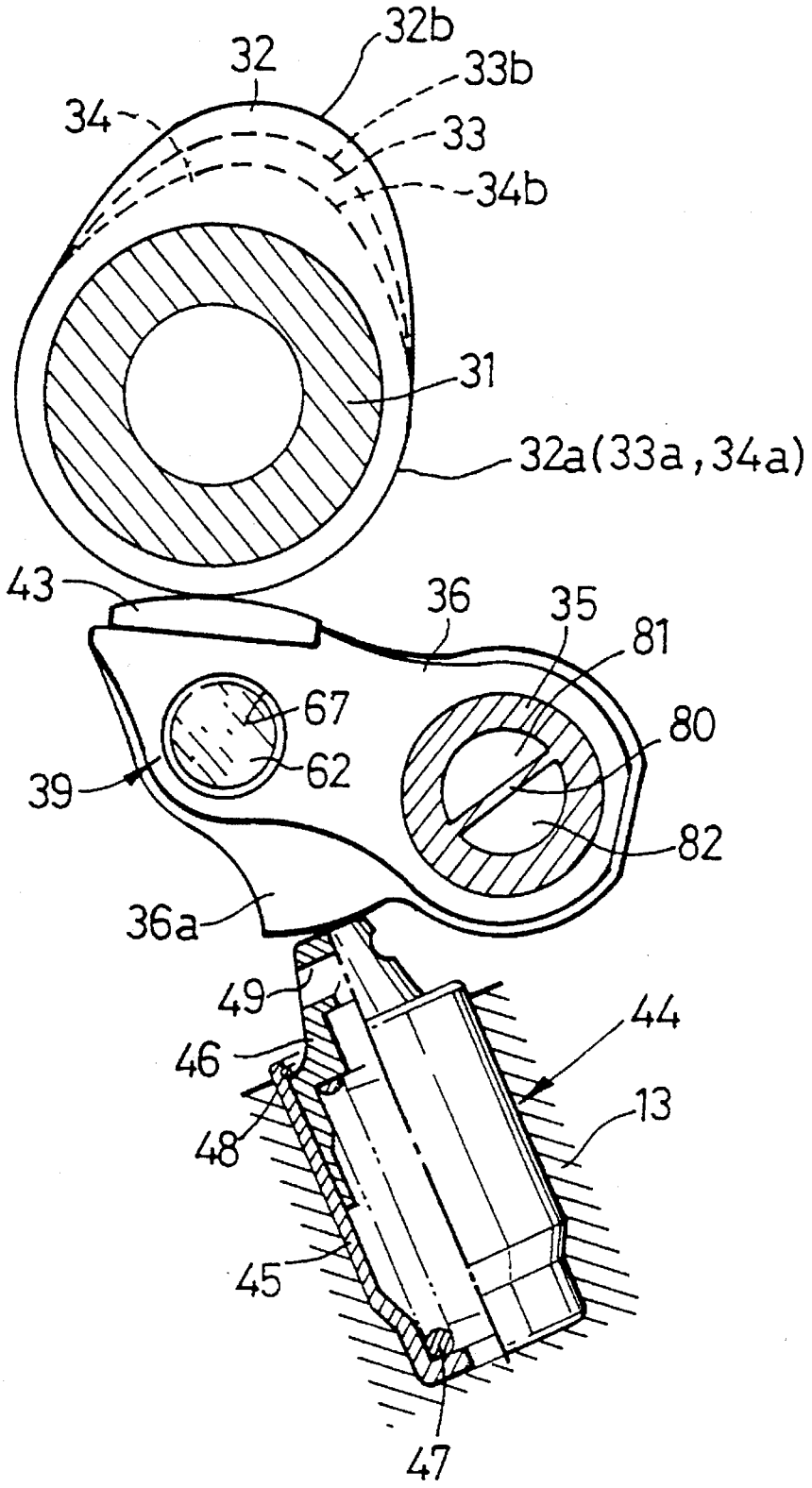
FIG. 4 is a sectional view taken along a line 4—4 in FIG. 2.

Referring also to FIG. 4, the cam shaft 31 is rotatably carried for rotation about an axis between a lower holder 41 (FIGS. 1 and 3) integrally provided in the cylinder head 13 and an upper holder 42 fastened to the lower holder 41. The pair of medium-speed cams 33, 33 are disposed on opposite sides of the high-speed cam 32, and the pair of low-speed cams 34, 34 are disposed between the high-speed cam 32 and the medium-speed cams 33, 33. The high-speed cam 32 has a profile corresponding to a high-speed operating range of the engine, and includes a base circle portion 32*a* formed around an outer periphery thereof, and a cam lobe 32*b* also formed around the outer periphery thereof and projecting radially outwardly from the base circle portion 32*a*. The medium-speed cam 33 has a profile corresponding to a medium-speed operating range of the engine, and includes a base circle portion 33*a* formed around an outer periphery thereof and having the same radius as the base circle portion 32*a* of the high-speed cam 32, and a cam lobe 33*b* also formed around the outer periphery thereof and projecting radially outwardly from the base circle portion 33*a* in a projecting amount smaller than that of the cam lobe 32b of the high-speed cam 32. Further, the low-speed cam 34 has a profile corresponding to a low-speed operating range of the engine, and includes a base circle portion 34*a* formed around an outer periphery thereof and having the same radius as the base circle portions 32*a* and 33*a*, and a cam lobe 34*b* also formed around the outer periphery thereof and projecting radially outwardly from the base circle portion 34*a* in a projecting amount smaller than that of the cam lobe 33*b* of the medium-speed cam 33.

The rocker shaft 35 is fixedly retained in the lower holder 41 of the cylinder head 13 at a location below the cam shaft 31 and has an axis parallel to the cam shaft 31. Swingably carried adjacent one another on the rocker shaft 35 are the pair of driving rocker arms 37, 37 independently operatively connected to the pair of intake valves 20, 20, the single first free rocker arm 36 sandwiched between the driving rocker arms 37, 37, and the pair of second free rocker arms 38, 38 disposed on the outer sides of and with the driving rocker arms 37, 37 interposed between the rocker arms 38, 38 themselves and the first free rocker arm 36.

The first free rocker arm 36 is swingably carried on the rocker shaft 35 to extend slightly below the cam shaft 31, and a cam slipper 43 is fixedly mounted on an upper portion of the first free rocker arm 36 adjacent its tip end to come into sliding contact with the high-speed cam 32.

The first free rocker arm 36 is resiliently biased in a direction to bring the cam slipper 43 into sliding contact with the high-speed cam 32 at all times by a lost motion mechanism 44 which is disposed in the cylinder head 13 substantially below the cam shaft 31. The lost motion mechanism 44 is comprised of a bottomed cylindrical member 45 fixedly fitted into the cylinder head 13 with its open end directed toward the first free rocker arm 36, a lifter 46 slidably received in the bottomed cylindrical member 45, a spring provided under compression between the bottomed cylindrical member 45 and the lifter 46, and a retaining ring 48 fitted to an inner surface of the open end of the bottomed cylindrical member 45 to prevent the discharge of the lifter 46 from the bottomed cylindrical member 45. The lifter 46 is provided with an open hole 49 for opening a space between the lifter 46 and the bottomed cylindrical member 45 to the outside. Thus, the lifter 46 projecting from the open end of the bottomed cylindrical member 45 is resiliently brought into sliding contact with a pressure receiving portion 36*a* provided at a lower portion of the first free rocker arm 36 adjacent its tip end, and the first free rocker arm 36 is normally maintained in sliding contact with the high-speed cam 32 by a resilient force of the lost motion mechanism 44.

Each of the driving rocker arms 37 is swingably supported on the rocker shaft 35 and extend toward the intake valve 20. A tappet screw 50 is inserted in a tip end of each of the driving rocker arms 37 such that the advancing and retreating position of the screw 50 can be adjusted. Therefore, the intake valves 20 are opened and closed in accordance with the swinging movements of the driving rocker arms 37. Further, as shown in FIG. 2, the threaded Position of each of the tappets 50 into the corresponding driving rocker arm 37, i.e., the operatively connected position of each of the driving rocker arms 37 with respect to the corresponding intake valves 20 is offset by a distance $d_1$ from the center of the driving rocker arm 37 along the axis of the rocker shaft 35. Thus, both the driving rocker arms 37 are operatively connected to the respective intake valves 20 at positions separated by substantially the same distances $d_2$, $d_2$, from the center of the first free rocker arm 36 along the axis of the rocker shaft 35.

In each of the driving rocker arms 37, a cam slipper 51 is fixedly mounted on an upper surface of an intermediate portion thereof between a position of operative connection to the intake valve 20 and the rocker shaft 35 to come into sliding contact with each of the low-speed cams 34.

Figure 5:
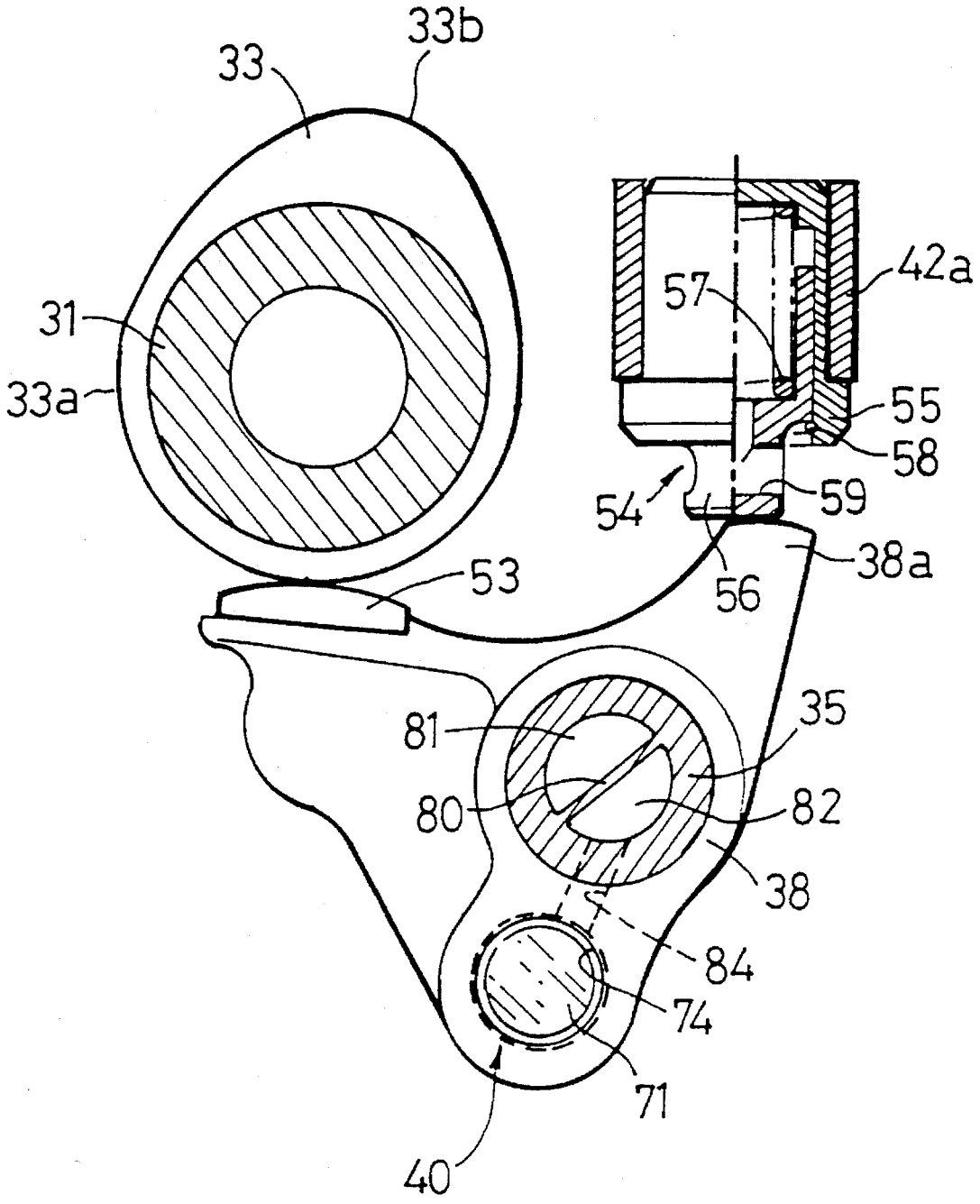
FIG. 5 is a sectional view taken along a line 5—5 in FIG. 2.

Referring also to FIG. 5, the second free rocker arms 38, 38 are swingably carried on the rocker shaft 35 to extend slightly below the cam shaft 31, and a cam slipper 53 is fixedly mounted on an upper portion of each of the second free rocker arms 38 adjacent its tip end to come into sliding contact with a corresponding one of the medium-speed cams 33.

Each of the second free rocker arms 38, 38 is resiliently biased in a direction to bring the cam slippers 53, 53 into sliding contact with the medium-speed cams 34, 34 by a separate lost motion mechanism 54 which is disposed on the upper holder 42 at a location closer to the axis of the rocker shaft 35, respectively. The lost motion mechanism 54 is comprised of a bottomed cylindrical member 55 fixedly fitted into a cylindrical support sleeve 42*a* integrally provided on the upper holder 42 with its open end directed toward the second free rocker arm 38, a lifter 56 slidably received in the bottomed cylindrical member 55, a spring 57 provided under compression between the bottomed cylindrical member 55 and the lifter 56, and a retaining ring 58 fitted to an inner surface of the open end of the bottomed cylindrical member 55 to prevent the discharge of the lifter 56 from the bottomed cylindrical member 55. The lifter 56 is provided with an open hole 59 for opening a space between the lifter 56 and the bottomed cylindrical member 55 to the outside. Thus, the lifter 56 projecting from the open end of the bottomed cylindrical member 55 is resiliently brought into sliding contact with a pressure receiving portion 38*a* which is provided at a base portion of the second free rocker arm 38 to project upwardly, and the second free rocker arm 38 is normally maintained in sliding contact with the medium-speed cam 34 by a resilient force of the lost motion mechanism 54.

Particularly referring to FIG. 3, the first connection switching means 39, which is disposed below the cam shaft 31 in the first free rocker arm 36 as well as the driving rocker arms 37, 37 disposed on the opposite sides of the first free rocker arm 36 and which is capable of interconnecting one of the driving rocker arm 37 and the first free rocker arm 36, includes a first switching pin 61 positioned in one of the driving rocker arms 37 and is capable of interconnecting that driving rocker arm 37 and the first free rocker arm 36, a second switching pin 62 positioned in the first three rocker arm 36 with one end abutting against the first switching pin 61 and is capable of interconnecting the first free rocker arm 36 and the other driving rocker arm 37, a limiting member 63 abutting against the other end of the second switching pin 62, and a return spring 64 for biasing the switching pins 61 and 62 and the limiting member 63 toward their disconnecting positions.

A bottomed first guide hole 65 opened toward the first free rocker arm 36 is provided in one of the driving rocker arms 37 and parallel to the rocker shaft 35, and the first switching pin 61 formed into a columnar shape is slidably fitted into the first guide hole 65. A hydraulic pressure chamber 66 is defined between one end of the first switching pin 61 and a closed end of the first guide hole 65.

A guide bore 67 is provided in the first free rocker arm 36 at a location corresponding to the first guide hole 61 and parallel to the rocker shaft 35 to extend between opposite sides, so that the second switching pin 62 with one end abutting against the other end of the first switching pin 61 is slidably fitted into the guide bore 67.

A bottomed second guide hole 68 opened toward the first free rocker arm 36 is provided in the other driving rocker arm 37 at a location corresponding to the guide bore 67 in parallel to the rocker shaft 35, so that the bottomed cylindrical limiting member 63 abutting against the other end of the second switching pin 62 is slidably fitted into the second guide hole 68. The return spring 64 is provided under compression between the limiting member 63 and a closed end of the second guide hole 68. A retaining ring 69 is fitted to an inner surface of the second guide hole 68 to engage the limiting member 63 to prevent the discharge of the limiting member 63 from the second guide hole 68. An opening bore 70 is provided in the closed end of the second guide hole 70.

In such first connection switching means 39, the application of a hydraulic pressure to the hydraulic pressure chamber 66 causes the first switching pin 61 to be moved and slidably fitted into the guide bore 67 and at the same time, causes the second switching pin 62 to be moved and slidably fitted into the second guide hole 68, thereby connecting the first free rocker arm 36 and the driving rocker arms 37, 37. When the hydraulic pressure in the hydraulic pressure chamber 66 is released, the first switching pin 61 is returned by a spring force of the return spring 64 to a position in which its surface abutting against the second switching pin 62 corresponds to the plane between one of the driving rocker arms 37 and the first free rocker arm 36, while the second switching pin 62 is returned to a position in which its surface abutting against the limiting member 63 corresponds to the plane between the first free rocker arm 36 and the other driving rocker arm 37, so that the first free rocker arm 36 and the driving rocker arms 37, 37 are disconnected from each other. Moreover, the connection and disconnection between the first free rocker arm 36 and the driving rocker arms 37, 37 are performed in a condition in which the first free rocker arm 36 is in sliding contact with the base circle portion 32*a* of the high-speed cam 32 and, at the same time, the driving rocker arms 37, 37 are in sliding contact with the base circle portions 34*a*, 34*a* of the low-speed cams 34, 34, respectively, i.e., when the first guide hole 65, the guide bore 67 and the second guide hole 68 are located coaxially.

Each of the two second connection switching means 40 are identical and are disposed at a location below the cam shaft 31 in the driving rocker arm 37 and the second free rocker arm 38. The two second connecting switching means 40, 40 are circumferentially spaced, relative to the rocker arm shaft 35, from the first connection switching means 39 to avoid interference between their respective compounds. Each second connection switching means 40 includes a switching pin 71 capable of interconnecting the second free rocker arm 38 and the driving rocker arm 37, a limiting member 72 abutting against the switching pin 71, and a return spring 73 for biasing the switching pin 71 and the limiting member 72 toward their disconnecting positions.

A bottomed guide hole 74 opened toward the driving rocker arm 37 is provided in the second free rocker arm 38 and parallel to the rocker shaft 35, so that the switching pin 71 formed into a columnar shape is slidably fitted into the guide hole 74. A hydraulic pressure chamber 75 is defined between one end of the switching pin 71 and a closed end of the guide hole 74.

A bottomed guide hole 76 opened toward the second free rocker arm 38 is provided in the driving rocker arm 37 at a location corresponding to the guide hole 74 and parallel to the rocker shaft 35, so that the bottomed cylindrical limiting member 72 abutting against the other end of the switching pin 71 is slidably fitted into the guide hole 76. The return spring 73 is provided under compression between the limiting member 72 and a closed end of the guide hole 76. A retaining ring 77 is fitted to an inner surface of the guide hole 76 to engage the limiting member 72 to prevent the discharge of the limiting member 72 from the guide hole 76. An opening bore 78 is provided in the closed end of the guide hole 76.

In such second connection switching means 40, the application of a hydraulic pressure to the hydraulic pressure chamber 75 causes the switching pin 71 to be moved and slidably fitted into the guide hole 76 until the cylindrical limiting member 72 abuts against the closed end of the guide hole 76, thereby connecting the second free rocker arm 38 and the driving rocker arm 37. In this connected condition, the hydraulic pressure in the hydraulic pressure chamber 75 causes a biasing force toward the first free rocker arm 36 to be applied to the driving rocker arm 37 through the switching pin 71 and the limiting member 72. When the hydraulic pressure in the hydraulic pressure chamber 75 is released, the switching pin 71 is returned by the spring force of the return spring 73 to a position in which its surface abutting against the limiting member 72 corresponds to the plane between the second free rocker arm 38 and the driving rocker arm 37, so that the second free rocker arm 38 and the driving rocker arm 37 are disconnected from each other. Moreover, the connection and disconnection between the second free rocker arm 38 and the driving rocker arm 37 are performed in a condition in which the second free rocker arm 38 is in sliding contact with the base circle portion 33*a* of the medium-speed cam 33 and, at the same time, the driving rocker arm 37 is in sliding contact with the base circle portion 34*a* of the low-speed cam 34, i.e., when both the guide holes 74 and 76 are located coaxially.

A first oil passage 81 and a second oil passage 82 are provided in the rocker shaft 35 in parallel to the axis thereof and partitioned from each other by a partition wall 80. A communication passage 83 is provided in one of the driving rocker arms 37 for permitting the first oil passage 81 to be normally in communication with the hydraulic pressure chamber 66 in the first connection switching means 39 irrespective of the swinging of the one driving rocker arm 37. Communication passages 84, 84 are provided in the pair of second free rocker arms 38, 38 for permitting the second oil passage 82 to be normally in communication with the hydraulic pressure chambers 75, 75 in the second connection switching means 40, 40 irrespective of the swinging of the second free rocker arms 38, 38, respectively.

The first and second oil passages 81 and 82 are connected to a hydraulic pressure source through hydraulic pressure control valves which are not shown. In the low-speed operating range of the engine, the hydraulic pressures in the first and second oil passages 81 and 82 are released. In the medium-speed operating range of the engine, the hydraulic pressure in the first oil passage 81 is released, but the second oil passage 82 is connected to the hydraulic pressure source. In the high-speed operating range of the engine, both of the first and second oil passages 81 and 82 are connected to the hydraulic pressure source. The connection and disconnection of the rocker arms 36, 37, 37, 38 and 38 by operation of the first connection switching means 39 and the pair of second connection switching means 40, 40 in response to the application and releasing of the hydraulic pressures to and from the first and second oil passages 81 and 82 will be described below with reference to FIG. 6.

First, in the low-speed operating range of the engine, the first connection switching means 39 and the pair of second connection switching means 40, 40 are in their disconnecting states, as shown in FIG. 6A, and the rocker arms 36, 37, 37, 38 and 38 are individually in their swingable states, because the hydraulic pressures in the first and second oil passages 81 and 82 have been released. Therefore, the pair of intake valves 20, 20 are opened and closed by the swinging movements of the driving rocker arms 37, 37 which are in sliding contact with the low-speed cams 34, 34, whereby the opening and closing operating characteristics of the intake valves 20, 20 correspond to the profile of the low-speed cams 34, 34.

In the medium-speed operating range of the engine, the hydraulic pressure in the first oil passage 81 is released, while the hydraulic pressure is applied to the second oil passage 82 as shown by stippling in FIG. 6B. This causes the pair of second connection switching means 40, 40 to be operated to interconnect one set of adjacent driving arm 37 and second free rocker arm 38 and the other set of adjacent driving rocker arm 37 and second free rocker arm 38 so that the driving rocker arms 37, 37 operatively connected respectively to the intake valves 20, 20 are swung along with the second free rocker arms 38, 38 by the medium-speed cams 33, 33, thereby causing the intake valves 20, 20 to be opened and closed with the operating characteristics corresponding to the profile of the medium-speed cams S3, 33.

Further, in the high-speed operating range of the engine, the application of the hydraulic pressure to both the first and second oil passages 81 and 82 causes the pair of second connection switching means 40, 40 to be maintained at the connecting states, while causing the first connection switching means 39 to be operated, thereby connecting the first free rocker arm 36 to the driving rocker arms 37, 37 located on the opposite sides of the first free rocker arm 36 as shown in FIG. 6C with the stippling showing the hydraulic pressure. That is, all the rocker arms 36, 37, 37, 38 and 38 are connected together, so that the driving rocker arms 37, 37 are swung along with the first free rocker arm 36 by the high-speed cam 32, whereby the opening and closing operating characteristics of the intake valves 20, 20 correspond to the profile of the high-speed cam 32.

Referring also to FIG. 7, the exhaust-side valve operating device 29 includes a cam shaft 86 rotatively driven at a reduction ratio of ½ from the crank shaft (not shown) of the engine, a single high-speed cam 87 and a pair of low/medium-speed 88, 88 which are provided on the cam shaft 86, a rocker shaft 89 fixedly disposed and parallel to the cam shaft 86, a single free rocker arm 90 and a pair of driving rocker arms 91, 91 which are swingably carried on the rocker shaft 89, and a connection switching means 92 provided on the rocker arms 90, 91, 91.

The cam shaft 86 is rotatably carried between the lower holder 41 and the upper holder 42 for rotation about an axis. The pair of low/medium-speed cams 88, 88 are disposed on opposite sides of the high-speed cam 87. The rocker shaft 89 is fixedly retained by the lower holder 41 at a location below the cam shaft 86 and has an axis parallel to the cam shaft 86. Three rocker arms are swingably carried on the rocker shaft 89 adjacent one another including a pair of driving rocker arms 91, 91 independently operatively connected to a pair of exhaust valves 22, 22 respectively, and a single free rocker arm 90 interposed between the driving rocker arms 91, 91.

The free rocker arm 90 is swingably carried on the rocker shaft 89 to extend slightly below the cam shaft 86, and a cam slipper 93 is fixedly mounted on an upper portion of the free rocker arm 90 adjacent its tip end to come into sliding contact with the high-speed cam 87. The free rocker arm 90 is resiliently biased in a direction to bring the cam slipper 93 into sliding contact with the high-speed cam 87 by a lost motion mechanism 94 which is disposed in the cylinder head 13 substantially below the cam shaft 86. The lost motion mechanism 94 has the same construction as the lost motion mechanism 44 in the intake-side valve operating device. Thus, the lost motion mechanism 94 is resiliently brought into sliding contact with a pressure receiving portion 90*a* provided at a lower portion of the free rocker arm 90 adjacent its tip end.

The driving rocker arms 91, 91 are swingably carried on the rocker shaft 89 to extend toward the exhaust valves 22, 22. A tappet screw 95 is threadedly fitted into a tip end of each of the driving rocker arms 91, 91 to abut against an upper end of each of the exhaust valves 22, 22, so that its advanced or retreated position can be adjusted. Therefore, the exhaust valves 22, 22 are opened and closed in response to the swinging movements of the driving rocker arms 91, 91, respectively.

The driving rocker arms 91, 91 have cam slippers 96, 96 fixedly mounted on upper surfaces of intermediate portions between the positions that driving rocker arms 91, 91 are operatively connected to the exhaust valves 22, 22 and the rocker shaft 89 to come into sliding contact with the low/medium-speed cams 88, 88.

The connection switching means 92 is of the same construction as the first connection switching means 39, is disposed at a location below the cam shaft 86 in the free rocker arm 90 and the driving rocker arms 91, 91 and includes a first switching pin 97 capable of interconnecting one of the driving rocker arms 91 and the free rocker arm 90, a second switching pin 98 having one end abutting against the first switching pin 97 and capable of interconnecting the free rocker arm 90 and the other driving rocker arm 91, a limiting member 99 abutting against the other end of the second switching pin 98, and a return spring 100 for biasing the switching pins 97 and 98 and the limiting member 99 toward their disconnecting positions.

A communication passage 102 is provided in one of the driving rocker arms 91 to lead to a hydraulic pressure chamber 102 defined between the one rocker arm 91 and the first switching pin 97. An oil passage 103 is coaxially provided in the rocker shaft 89 to normally communicate with the communication passage 102.

In such connection switching means 92, the hydraulic pressure in the oil passage 103 is released in the low-speed and medium-speed operating ranges of the engine, and a hydraulic pressure is applied to the oil passage in the high-speed operating range of the engine. More specifically, in the low-speed and medium-speed operating ranges of the engine, the connection switching means 92 is in its disconnecting state, wherein the rocker arms 90, 91, 91 are in their individually swingable states. Therefore, the pair of exhaust valves 22, 22 are opened and closed by the swinging movements of the driving rocker arms 91, 91 which are in sliding contact with the low/medium-speed cams 88, 88, respectively, wherein the opening and closing characteristics of the exhaust valves 22, 22 correspond to the profiles of the low-speed and medium-speed cams 88, 88. In the high-speed operating range of the engine, the hydraulic pressure is applied to the oil passage 103, thereby operating the connection switching means 92 to connect the free rocker arm 90 to the driving rocker arms 91, 91 located on the opposite sides of the free rocker arm 90. That is, all the rocker arms 90, 91, 91 are connected together, so that the driving rocker arms 91, 91 are swung along with the free rocker arm 90 by the high-speed cam 87, wherein the opening and closing characteristics of the exhaust valves 22, 22 correspond to the profile of the high-speed cam 87.

The operation of this embodiment now will be described. With the intake-side valve operating device 28, the pair of intake valves 20, 20 are opened and closed with the operating characteristics corresponding to the profile of the low-speed cams 34, 34 in the low-speed operating range of the engine, with the operating characteristics corresponding to the profile of the medium-speed cams 33, 33 in the medium-speed operating range of the engine, and with the operating characteristics corresponding to the profile of the high-speed cam 32 in the high-speed operating range of the engine. On the other hand, with the exhaust-side valve operating device 29, the pair of exhaust valves 22, 22 are opened and closed with the operating characteristics corresponding to the profile of the low/medium-speed cams 88, 88 in the low-speed and medium-speed operating ranges of the engine and with the operating characteristics corresponding to the profile of the high-speed cam 87 in the high-speed operating range of the engine.

Therefore, in the low-speed operating range of the engine, it is possible to reduce the overlapping of the time points at which the intake valves 20, 20 and the exhaust valves 22, 22 are opened, to inhibit the blow-by and blow-back of an intake gas to the utmost, to enhance the substantial intake gas filling efficiency, to provide a reduction in fuel consumption, to provide a combustion stabilization during idling and to improve drivability.

In the medium-speed operating range of the engine, the intake valves 20, 20 are opened and closed by the medium-speed cams 33, 33 having the profile suitable for the intake characteristics in the medium-speed operating range. Thus, it is possible to prevent the output torque from being reduced and to substantially reduce the fuel consumption. It should be noted that if the intake valves 20, 20 were opened and closed by the low-speed cams 34, 34 in the medium-speed operating range of the engine, a back-flow of the intake gas would be generated within the intake pipe by the early closing of the intake valves, resulting in a reduced substantial intake gas filling efficiency. If the intake valves 20, 20 were opened and closed by the high-speed cam 32 in the medium-speed operating range of the engine, a blow-back of the intake gas from the combustion chamber 15 would be generated, also resulting in a reduced substantial intake gas filling efficiency.

Further, in the high-speed operating range of the engine, the intake valves 20, 20 are opened and closed by the high-speed cam 32. Thus, it is possible to determine the closing time point for the intake valves 20, 20 at a predetermined crank angle after the piston has passed a lower dead center, so that the positive pressure of the intake gas is substantially equal to the internal pressure in the cylinder 12, and to utilize an inertial effect to the maximum to enhance the intake gas filling efficiency and to considerably increase the power output.

In the high-speed operating range of the engine, with the intake-side valve operating device 28, the first free rocker arm 36 is swung by the high-speed cam 32 in a state in which it has been connected to the driving rocker arms 37, 37 located on the opposite sides of the first free rocker arm 36 by the first connection switching means 39. In this condition, due to the presence of clearances necessarily produced between the outer surfaces of the first and second switching pins 61 and 62 of the first connection switching means 39 and the inner surface of the first guide hole 65, the guide bore 67 and the second guide hole 68, the driving force from the high-speed cam 32 is applied in a direction to tend to separate the lower portions of the connected portions of the first free rocker arm 36 and the driving rocker arms 37, 37 from each other, and reaction forces from the valve springs 26, 26 are applied in a direction to the upper portions of the connected portions of the first free rocker arm 36 and the driving rocker arms 37, 37 from each other. However, in the high-speed operating range of the engine, the pair of second connection switching means 40, 40 are also in their connecting states, wherein a biasing force is applied from the second connection switching means 40, 40 to the driving rocker arms 37, 37 in a direction toward the first free rocker arm 36 located between the driving rocker arms 37, 37. Therefore, it is possible to inhibit the separation caused by the driving force from the high-speed cam 32 as well as by the reaction forces from the valve springs 26, 26 to enhance the connection rigidity between the first free rocker arm 36 and the driving rocker arms 37, 37. In addition, it is possible to inhibit the generation of sounds with the separation and to bring the first and second switching pins 61 and 62 into uniform contact with the inner surfaces of the first guide hole 65, the guide bore 67 and the second guide hole 68 to increase the durability of the switching pins 61 and 62 as well as the first guide hole 65, the guide bore 67 and the second guide hole 68, and to prevent the uneven abutment of the tappet screws 50, 50 threadedly engaged in the driving rocker arms 37, 37 against the upper ends of the intake valves 20, 20.

During such an operation in the high-speed operating range, the intake valves 20, 20 are operatively connected to the driving rocker arms 37, 37 at locations spaced apart substantially by distances $d_2$, $d_2$ from the center of the first free rocker arm 36 along the axis of the rocker shaft 35. Thus, the driving rocker arms 37, 37 as well as the intake valves 20, 20 independently operatively connected to the driving rocker arms 37, 37 are disposed symmetrically with respect to a plane which passes through the center of the high-speed cam 32 along the axis of the cam shaft 31 and which is perpendicular to the axis of the cam shaft 31, so that the driving force from the high-speed cam 32 is applied equally to the intake valves 20, 20.

Moreover, in the high-speed operating range, the first connection switching means 39 is brought into its connecting state, while the pair of second connection switching means 40, 40 are in their connecting states, thereby connecting all the rocker arms 36, 37, 37, 38 and 38 together. Therefore, when the operational condition is changed from the medium-speed operating range to the high-speed operating range, the hydraulic pressure may be applied to the hydraulic pressure chamber 66 in the first connection switching means 39. When the operational condition is changed from the high-speed operating range to the medium-speed operating range, the hydraulic pressure in the hydraulic pressure chamber 66 may be released. Thus, it is possible to promptly perform the switching operation with the change between medium-speed operating range and the high-speed operating range.

In the medium-speed operating range of the engine, the second free rocker arms 38, 38 swung by the medium-speed cams 33, 33 are connected to the driving rocker arms 37, 37, respectively, but the positions of operative connection of the intake valves 20, 20 to the driving rocker arms 37, 37 are offset toward the second free rocker arms 38, 38. Therefore, even in the medium-speed operating range, the deflection of the driving forces from the medium-speed cams 33, 33 relative to the intake valves 20, 20 can be inhibited to the utmost, thereby preventing uneven wear of the sliding contact surfaces of the cam slippers 53, 53 provided on the second free rocker arms 38, 38 by the medium-speed cams 33, 33.

Further, the lost motion mechanisms 54, 54 for resiliently biasing the second free rocker arms 38, 38 in a direction to bring them into sliding contact with the medium-speed cams 33, 33 are resiliently in sliding contact with the pressure receiving portions **38*a* and 38*a* provided on the second free rocker arms 38, 38 in the vicinity of the axis of the rocker shaft 35. This makes it possible to inhibit increases in inertial weights of the second free rocker arms 38, 38**.

Moreover, the first connection switching means 39 is disposed in a location below the cam shaft 31 in the first free rocker arm 36 and the driving rocker arms 37, 37 located on the opposite sides of the first free rocker arm S6, and the second connection switching means 40, 40 are also disposed at the locations below the cam shaft 31 in the driving rocker arms 37, 37 and the second free rocker arms 38, 38. Therefore, when these connection switching means 39, 40, 40 are in their connecting states, the driving forces from the cams 32, 33, 33, 34 and 34 can be received by the switching pins 61, 62, 71, 71 which are components of the connection switching means 39, 40, 40, thereby enhancing the rigidity of the connected rocker arms. In contrast, suppose that the connection switching means were disposed on the opposite side from the cams 32 to 34 and the intake valves 20, 20 with respect to the rocker shaft 35, the clearance between each of the rocker arms and each of the switching pins and the clearance between the adjacent rocker arms in the connected portions provided by the connection switching means would be increased in accordance with the lever ratio by the driving forces applied from the cams 32 to 34 to the adjacent connected rocker arms in a direction to move these arms away from each other, resulting in a relatively weak connection rigidity.

Although the preferred embodiment of the present invention has been described in detail, it will be understood that the present invention is not limited to the above-described embodiment, and various modifications can be made without departing from the spirit and scope of the invention defined in claims.

For example, the present invention descried with respect to intake valves is applicable to a valve operating device for a pair of exhaust valves.

We claim:

1. A valve operating device for use in an internal combustion engine for varying operating characteristics of a pair of engine valves in multi-stages depending upon operating conditions of the engine, comprising a cam shaft which is provided with high-speed cam having a profile corresponding to a high-speed operating range of the engine, a pair of medium-speed cams disposed on opposite sides of said high-speed cam and having a profile corresponding to a medium-speed operating range of the engine, and a pair of low-speed cams disposed between said medium-speed cams and said high-speed cam, respectively, and having a profile corresponding to a low-speed operating range of the engine, a rocker shaft provided with a first free rocker arm positioned for sliding contact with said high-speed cam, a pair of driving rocker arms operatively connected to the pair of engine valves, respectively, and positioned for sliding contact with said low-speed cams, said pair of driving rocker arms positioned on either side of said first free rocker arm, and a pair of driving rocker arms is positioned for a sliding contact with said medium-speed cams and such that each of said driving rocker arms is interposed between one of the second free rocker arms and said first free rocker arm, all of said rocker arms being commonly carried on said rocker shaft for relatively swinging movements, a first connection switching means provided in said first free rocker arm and said driving rocker arms and which is switchable between a state in which said first connection switching means connects said first free rocker arm and said driving rocker arms in the high-speed operating range of the engine and a stat in which it disconnects said first free rocker arm and said driving rocker arms in the low-speed and medium-speed operating ranges of the engine, and second connection switching means provided in each pair of adjacent driving rocker arm and second free rocker arm and switchable between a state in which each said second connection switching means connects said adjacent driving rocker arm and second free rocker arm, and a state in which each said second connection switching means disconnects said adjacent driving rocker arm and second free rocker arm in the low-speed operating range of the engine.

2. The valve operating device of claim 1 wherein each said second connection switching means applies a force from said second free rocker arm to said adjacent driving rocker arm in a direction toward said first free rocker arm when said second connection switching means is in said connecting state.

3. The valve operating device of claim 1, wherein each said driving rocker arm has a center plane perpendicular to said rocker shaft, and said operative connection of each of said driving rocker arms to one of said engine valves is spaced from said center plane in a direction toward the adjacent said second free rocker arm.

4. The valve operating device of claim 2 wherein each said driving rocker arm has a center plane perpendicular to said rocker shaft, and said operative connection of each of said driving rocker arms to one of said engine valves is spaced from said center plane in a direction toward the adjacent said second free rocker arm.

5. The valve operating device of claim 1 wherein said first connection switching means is circumferentially spaced from said second connection switching means relative to said rocker shaft.

6. A valve operating device for use in an internal combustion engine for varying operating characteristics of a pair of engine valves in multi-stages depending upon operating conditions of the engine, comprising a cam shaft provided with a high-speed cam at a central location relative to the engine valves and a plurality of pairs of cams for other speeds of the engine with each pair of cams having said cams equidistant from said high-speed cam, a plurality of rocker arms pivotally mounted on a rocker shaft with one of said rocker arms engaging each of said cams, a first pair of said rocker arms positioned equidistant from said high-speed cam having means operatively connected to the pair of engine valves and engaging one of said pairs of cams having a profile for operating the engine in a low-speed range, a first connection switching means for connecting a rocker arm engaging said high-speed cam to a pair of adjacent rocker arms, and second connection switching means for connecting at least two pairs of said rocker arms engaging said pairs of cams for other speeds of the engine, at least one of said connection switching means serving to connect said first pair of rocker arms to at least either said rocker arm engaging said high-speed cam or another pair of rocker arms engaging a pair of cams for operating the engine at other speeds whereby a lead transfer from all of said rocker arms to said pair of engine valves is balanced relative to said central location in all speeds of engine operation.

* * * * *

UNITED STATES PATENT AND TRADEMARK OFFICE

CERTIFICATE OF CORRECTION

PATENT NO. : 5,456,225

DATED : October 10, 1995

INVENTOR(S) : Oikawa et al.

It is certified that error appears in the above-indentified patent and that said Letters Patent is hereby corrected as shown below:

Column 12, line 43, before "rocker" delete "driving" and- insert — second free —.

Column 14, line 20, delete "lead" and insert — load —.

Signed and Sealed this

Twenty-second Day of July, 1997

Bruce Lehman

*Attest:*

BRUCE LEHMAN

*Attesting Officer*

*Commissioner of Patents and Trademarks*